US011313387B2

(12) United States Patent
Bruck et al.

(10) Patent No.: US 11,313,387 B2
(45) Date of Patent: Apr. 26, 2022

(54) SYSTEM FOR CHARGING AND DISCHARGING AT LEAST ONE HYDRAULIC ACCUMULATOR

(71) Applicant: HYDAC FLUIDTECHNIK GMBH, Sulzbach/Saar (DE)

(72) Inventors: Peter Bruck, Althornbach (DE); Christian Stauch, Schwalbach (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 0 days.

(21) Appl. No.: 17/267,554

(22) PCT Filed: Jul. 30, 2019

(86) PCT No.: PCT/EP2019/070474
§ 371 (c)(1),
(2) Date: Feb. 10, 2021

(87) PCT Pub. No.: WO2020/035304
PCT Pub. Date: Feb. 20, 2020

(65) Prior Publication Data

US 2021/0317846 A1 Oct. 14, 2021

(30) Foreign Application Priority Data

Aug. 11, 2018 (DE) ..... 10 2018 006 380.2

(51) Int. Cl.
*F15B 1/027* (2006.01)
*F15B 1/033* (2006.01)
*F15B 21/14* (2006.01)

(52) U.S. Cl.
CPC ..... *F15B 1/027* (2013.01); *F15B 1/0275* (2013.01); *F15B 1/033* (2013.01); *F15B 21/14* (2013.01); *F15B 2211/3052* (2013.01)

(58) Field of Classification Search
CPC ..... F15B 1/033; F15B 1/027; F15B 1/0275; F15B 2211/3052; F15B 21/14
See application file for complete search history.

(56) References Cited

U.S. PATENT DOCUMENTS 3,768,375 A * 10/1973 Flaschar ..... F15B 1/027 91/459
3,951,043 A 4/1976 Keady
(Continued)

FOREIGN PATENT DOCUMENTS

DE 30 11 493 10/1981
DE 33 27 978 2/1985
(Continued)

OTHER PUBLICATIONS

Shuttle Valves NPL.*
(Continued)

*Primary Examiner* — Dustin T Nguyen
(74) *Attorney, Agent, or Firm* — Wenderoth, Lind & Ponack, L.L.P.

(57) ABSTRACT

A system for charging and discharging at least one hydraulic accumulator (10) can be connected to a valve control device (12). The valve control device (12) has at least one logic valve (14). A shuttle valve (16) and a hydraulically operated switching valve (18) are also provided. The valves (14, 16, 18) are interconnected such that the hydraulically actuatable switching valve (18) compares the accumulator pressure ($p_A$) to a minimum accumulator pressure ($p_{A0}$) that can be adjusted via the control pressure setting of this switching valve (18).

21 Claims, 2 Drawing Sheets

(56) References Cited

U.S. PATENT DOCUMENTS

| | | | | |
|---|---|---|---|---|
| 4,665,697 | A * | 5/1987 | Dantlgraber | F15B 1/027 60/418 |
| 6,357,230 | B1 * | 3/2002 | A'Hearn | E02F 9/2207 60/413 |
| 9,115,702 | B2 * | 8/2015 | Hugosson | F15B 13/0431 |
| 9,429,175 | B2 * | 8/2016 | Coolidge | F15B 21/06 |
| 10,612,567 | B2 * | 4/2020 | Hinsberger | G05D 16/2097 |
| 2019/0277313 | A1 | 9/2019 | Hinsberger | |

FOREIGN PATENT DOCUMENTS

| | | |
|---|---|---|
| DE | 38 15 873 | 11/1989 |
| DE | 10 2016 006 545 | 11/2017 |
| EP | 0 044 065 | 1/1982 |

OTHER PUBLICATIONS

Inverse Shuttle Valves NPL.*
International Search Report (ISR) dated Nov. 5, 2019 in International (PCT) Application No. PCT/EP2019/070474.

* cited by examiner

SYSTEM FOR CHARGING AND DISCHARGING AT LEAST ONE HYDRAULIC ACCUMULATOR

FIELD OF THE INVENTION

The invention relates to a system for charging and discharging at least one hydraulic accumulator that can be connected to a valve control device. The valve control device comprises at least one logic valve. More particularly, the invention relates to a system provided for controlling the charge state of hydraulic accumulators used for hydraulic hybrid applications for the intermediate storage and subsequent recovery of excess hydraulic energy.

BACKGROUND OF THE INVENTION

In hydraulic systems, excess energy, for instance braking energy or potential energy, is gained when lowering loads. The energy is temporarily stored in the hydraulic accumulator and can be recovered to support or unload drive units for hydraulic consumers, such as drives or working cylinders. For this purpose, depending on the system status and the charge state of the hydraulic accumulator, the connection of the accumulator to the hydraulic system must be blocked or opened as required to charge the accumulator by excess energy or to recover stored energy by discharging the accumulator.

For this purpose, a non-return function is required at the accumulator tap. If the system pressure is higher than the accumulator pressure, the accumulator is charged. If the system pressure is lower, the non-return function prevents the accumulator from discharging. In this respect, it is state of the art to use an unlockable non-return valve. Charging occurs in the direction of flow. A discharge process can be triggered by unlocking the valve. The non-return function can also be implemented by using a solenoid valve, which can be used to actively connect and disconnect the accumulator.

However, the switching dynamics of common solenoid valves are not sufficient for use in hydraulic hybrid systems. Occurring switching delays cause undesired pressure increases in the system. By using an unlockable non-return valve higher switching dynamics are indeed realizable. However, the valve function does not prevent the accumulator from discharging below a minimum value of the accumulator pressure. If the accumulator is discharged below its pre-fill pressure, there is a risk of damage to the separating element of the accumulator concerned. A valve control device, disclosed in DE 10 2016 006 545 A1 and connected to a hydraulic accumulator for a pressure adjustment, is also not suitable for a use in hydraulic hybrid applications.

SUMMARY FOR THE INVENTION

Based on this state of the art, the invention addresses the problem of providing a system for charging and discharging at least one hydraulic accumulator, wherein the system particularly meets the demands on hydraulic hybrid applications.

According to the invention, this problem is basically solved by a system having a shuttle valve and a switching valve. The valves are interconnected such that the hydraulically actuatable switching valve compares the accumulator pressure to a minimum accumulator pressure that can be adjusted via the control pressure setting of this switching valve. Because the valve control device of the system according to the invention operates without solenoid valve actuation, high switching dynamics are ensured. Furthermore, because the shuttle valve and the switching valve are used to compare the accumulator pressure to an adjustable minimum accumulator pressure, the system according to the invention can also be operated reliably by setting the lowest accumulator pressure to an optimum pressure value for the operation of the pressure accumulator.

In a preferred embodiment of the system according to the invention, as long as the accumulator pressure is lower than the minimum accumulator pressure, the switching valve is located in the valve position each caused by a preferably adjustable spring and by the control pressure. In doing so, the accumulator pressure passes on to the one piston end of the piston of the logic valve, which, in this way acting as a non-return valve, prevents the respective hydraulic accumulator from being discharged below the set minimum accumulator pressure. Damage to the separating element of the accumulator because of a pressure drop below the minimum accumulator pressure is then effectively prevented.

In a further preferred embodiment of the system according to the invention, the valves are interconnected such that, as soon as the accumulator pressure is above the set minimum accumulator pressure, the switching valve changes to its actuated switching position and permits the inverse shuttle valve to signal the respective lower of the two pressures in the form of the accumulator pressure and a system pressure of a hydraulic system, connected to the system, to the one piston side of the piston of the logic valve. This connection permits the flow through the logic valve in both directions, thus from the hydraulic accumulator to the hydraulic system and vice versa. The hydraulic accumulator then can be both charged and discharged. If the accumulator pressure is above the system pressure, the hydraulic accumulator is discharged via the logic valve towards the hydraulic system. In the opposite case, if the accumulator pressure is lower than the system pressure, the hydraulic accumulator is charged by the hydraulic system via the logic valve.

In a preferred embodiment of the system according to the invention, an active shut-off device is provided. The shut-off device comprises a solenoid valve that, unactuated or actuated via a further shuttle valve, signals the respective higher of the two pressures of accumulator pressure and system pressure to one side of the piston of the logic valve. In this way, the logic valve held in its closed position shuts off the hydraulic accumulator from the hydraulic system and inactivates the hydraulic-mechanical accumulator control. Shutting off the accumulator can prevent an incidental charging of the accumulator during operating states in which the complete drive power is required to supply the hydraulic functions. In this way, the accumulator's ability to absorb excess energy is maintained in the further course of the work cycle. Also, incidental charging of the accumulator during operating conditions is prevented, in which full drive power is required, which would result in a reduction in the available power that can be provided. The use of a solenoid valve as a pilot valve for the shut-off function is not critical, because only a low switching dynamic is required for this pilot function.

It is further advantageous that a discharging valve is provided for a safe discharge of the hydraulic accumulator into a tank port or return port, for instance during a machine standstill.

In a preferred embodiment of the system according to the invention, the logic valve forms a type of stepped piston on its side, opposite from the one side of the piston. This stepped piston controls a fluid connection between the hydraulic system and the respective hydraulic accumulator.

The solenoid can be formed both de-energized open and de-energized closed. Alternatively, the adjustment of the control pressure for the switching valve can also be formed to be proportional to current or voltage.

Particularly advantageously, the system according to the invention is used to control the fluid-conveying connection between a hydraulic accumulator for energy recovery and a hydraulic system. In this way, the interconnection of valves can be used to charge, discharge and shut-off the hydraulic accumulator as required.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
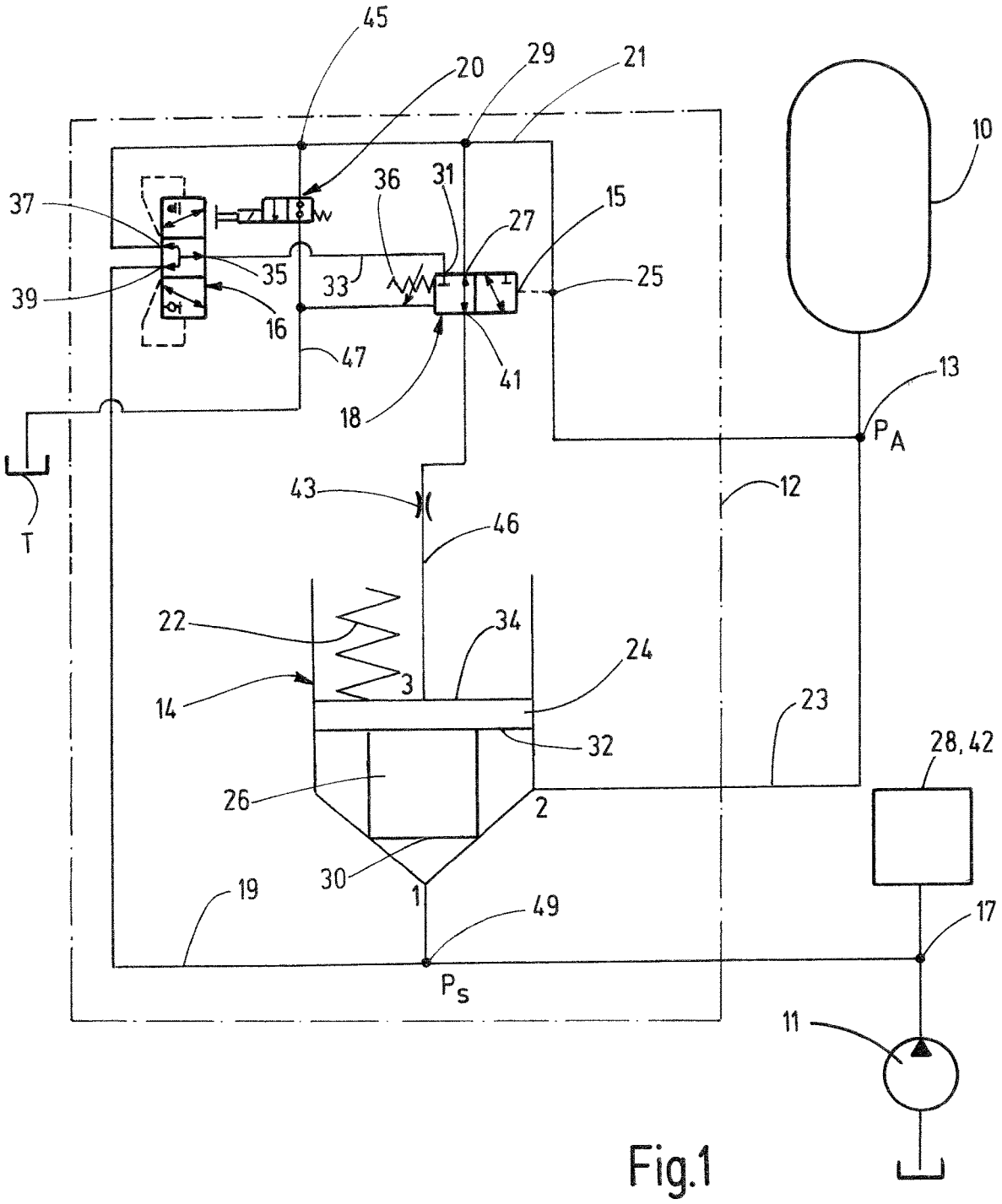
FIG. 1 is a schematic circuit diagram of a first exemplary embodiment of the system according to the invention for charging and discharging at least one hydraulic accumulator.

FIG. 1 shows a circuit diagram of a first exemplary embodiment of the system according to the invention, comprising a valve control device 12 connected to a hydraulic accumulator 10. To be used as an energy intermediate storage, the hydraulic accumulator 10 is connected to a hydraulic system 28, 42 via the valve control device 12. The hydraulic system 28, 42 has a hydraulic consumer, for instance in the form of a working cylinder or traction drive with associated control electronics (all not shown). For pressure supply of the system by a system pressure $p_S$ a hydraulic pump 11 is provided, which can be driven by a drive motor, not shown, of an associated equipment, such as a mobile working device. For controlling the inflow and outflow of fluid to and from the accumulator tap 13 of the accumulator 10, the valve control device 12 has a logic valve 14 providing a non-return function.

The construction of the logic valve 14 matches that of the logic valve used in DE 10 2016 006 545 A1. The first valve port 1 of the logic valve 14 is connected to the pressure side of the hydraulic pump 11, having the system pressure $p_S$. The second valve port 2 of the logic valve 14 is connected to the accumulator tap 13, having the accumulator pressure $p_A$, of the accumulator 10. The third valve port 3 of the logic valve 14 is connected to the output side of a hydraulically actuated switching valve 18. Switching valve 18 is formed as a 3/2-way valve, which can be brought to the unactuated switching position, shown in FIG. 1, by an adjustable spring 36. For transfer to the actuated, second switching position, the control port 15 of the switching valve 18 is connected to the accumulator tap 13, having the accumulator pressure $p_A$. The outlet port 41 of the switching valve 18 is connected to the third valve port 3 of the logic valve 14, such that the effective surface area 34 of the piston 24 of the logic valve 14 can be loaded with control pressure, which can be supplied from the switching valve 18.

A first input-sided valve port 27 of the switching valve 18 is connected to the accumulator tap 13, and therefore, pressurized to the accumulator pressure $p_A$. The second input-sided valve port 31 of the switching valve 18 is connected to the output 35 of a first shuttle valve 16. One or a first input 39 of the first shuttle valve 16 is pressurized to the system pressure $p_S$. The other or second input 37 of the shuttle valve is connected to the accumulator tap 13 and pressurized to the accumulator pressure $p_A$.

As the first shuttle valve 16 is inversely operating, its output 35 signals the respective lower pressure value of the system pressure $p_S$ or the accumulator pressure $p_A$ of the accumulator tap 13 to the second input port 31 of the switching valve 18. As long as the accumulator pressure $p_A$ is lower than the minimum accumulator pressure $p_{AO}$, set by the spring 36, the switching valve 18 is in the unactuated position shown. In the unactuated position, switching valve 18 signals or conveys the accumulator pressure $p_A$ to the effective surface area 34 of the piston 24 of the logic valve 14. As a result, the logic valve 14 acts as a non-return valve blocking the flow from the accumulator tap 13, such that the accumulator 10 can only be charged from the pressure side 17, having the system pressure $p_S$, of the hydraulic pump 11. If the accumulator pressure $p_A$ is above the set minimum pressure value, then the switching valve 18 changes to the actuated switching position and permits this first shuttle valve 16 to signal the respective lower of the two pressures $p_A$ and $p_S$ to the effective surface area 34 of the piston 24 of the logic valve 14. As a result of that the lower pressure is acting on the effective surface area 34 of the piston 24 of the logic valve 14, the logic valve 14 now allows flow in both directions, i.e. the accumulator 10 can be both charged and discharged.

The interconnection of the above components has, as a first line main branch, a pressure line 19, pressurized to the system pressure $p_S$. Pressure line 19 extends in fluid communication from the pressure side 17 of the hydraulic pump 11 to the first inlet 39 of the first shuttle valve 16. Also, pressure line 19, at a junction 49, is connected in fluid communication to the first valve port 1 of the logic valve 14. As a second main branch, an accumulator pressure line 21 is provided, pressurized to the accumulator pressure $p_A$ and forming the fluid communication connection between the accumulator tap 13 and the second inlet 37 of the first shuttle valve 16. As a third main branch an accumulator charge-discharge line 23 is provided, which extends in fluid communication from the accumulator tap 13 to the second valve port 2 of the logic valve 14. The output port 41 of the switching valve 18 is connected in fluid communication to the third valve port 3 of the logic valve 14 via a control line 46, in which an orifice 43 is located. On the input side, the first input port 27 of the switching valve 18 is connected in fluid communication to the accumulator pressure line 21 at a junction 29. The second input port 31 of the switching valve 18 is connected in fluid communication to the output 35 of the shuttle valve 16 via an output line 33. For its comparison function, for which the accumulator pressure $p_A$ counteracts the set force of the spring 36, the control port 15 is connected in fluid communication to the accumulator pressure line 21 at a junction 25. The circuit is completed by a discharge valve 20, which can be actuated electromagnetically and which inlet-sided is connected in fluid communication to the accumulator pressure line 21 at a junction 45, and thus, to the hydraulic accumulator 10, and which is outlet-sided connected in fluid communication to the vent or tank port T or return port via a tank line 47.

For its lock/non-return function, the logic valve 14, as disclosed in DE 10 2016 006 545 A1, is formed by a 2-way built-in valve, whose control piston 24 has three effective surface areas 30, 32 and 34, as well as a piston step 26 having a control geometry. The pressure of the first valve port 1, which is connected to the junction 49 of the pressure line 19 and which is pressurized to the system pressure $p_S$, acts on the first effective surface area 30. The second effective surface area 32 is exposed to the pressure from the second valve port 2 and is sized less than one hundredth of the size of the first effective surface area 30. Accordingly, the third effective surface area 34, which is pressurized by the fluid pressure at the third valve port 3, forms the largest effective surface area and corresponds to the sum of the first and second effective surface areas 30 and 32. The prestress or bias of the spring 22 presses the piston step 26, forming a control pin, of the valve piston 24 into the seat. In this position, in which the volume flow through the logic valve 14 is blocked, the piston 24 is held by the accumulator pressure, acting at the third effective surface area 34, when the switching valve 18 is arranged in the switching position, shown in FIG. 1. In the actuated position of the switching valve 18 and the then lower respective pressure of $p_S$ and $p_A$ at the third effective surface area 34, the flow through the logic valve 14 is permitted in accordance with the pressures present at the valve ports 1 and 2.

Figure 2:
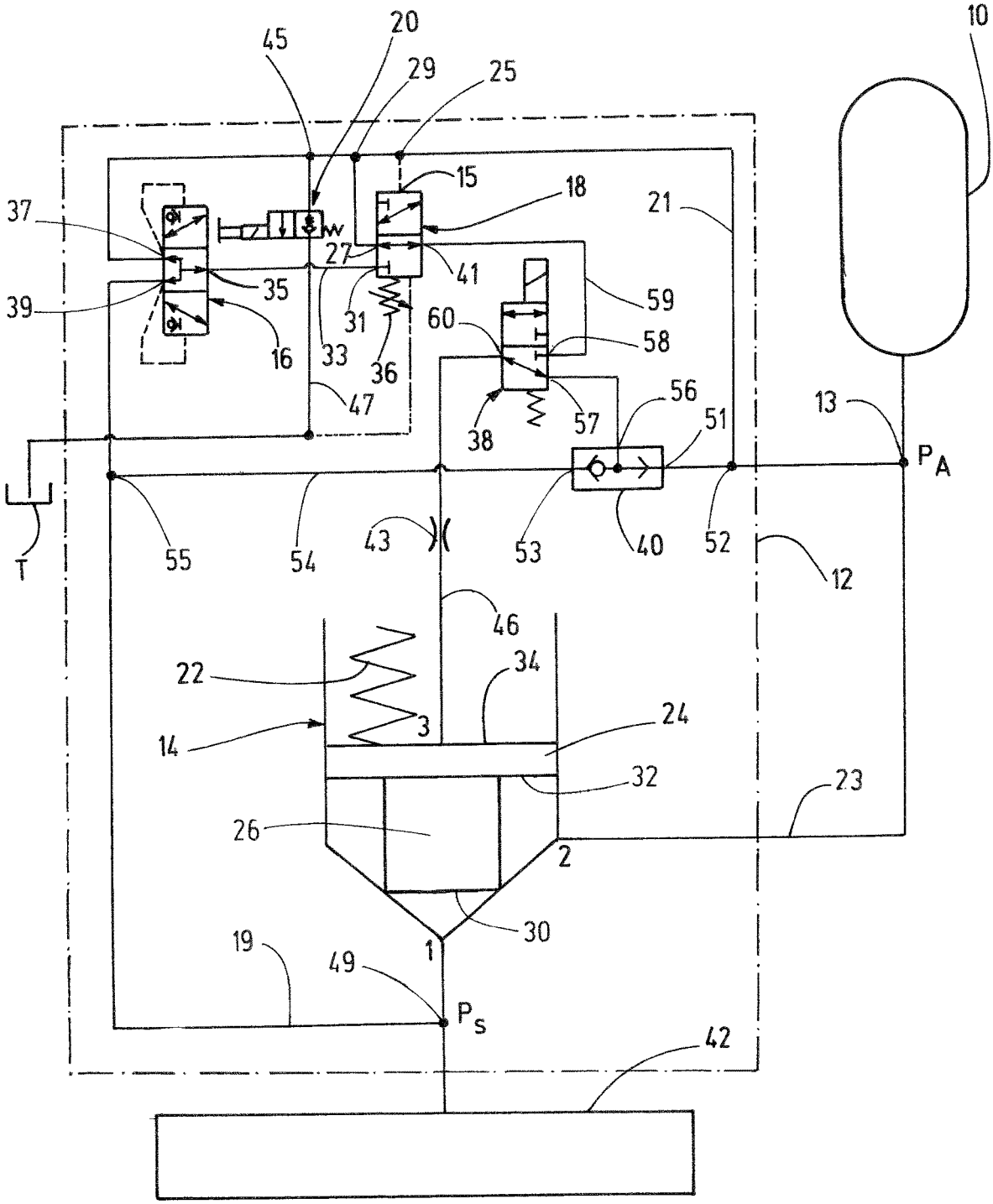
FIG. 2 is a schematic circuit diagram of a second exemplary embodiment of the system according to the invention for charging and discharging at least one hydraulic accumulator.

FIG. 2 shows the circuit diagram of a second exemplary embodiment of the system according to the invention. The second exemplary embodiment is described only to the extent that it differs substantially from the first exemplary embodiment, and the explanations given so far also apply to the second exemplary embodiment. The second exemplary embodiment differs in particular from the first exemplary embodiment in that it comprises a shut-off device, that can be activated. By the shut-off device, the function of the control device 12 can be deactivated. The shut-off device has an electromagnetically actuated shift valve 38 in the form of a 3/2-way valve and a second shuttle valve 40. One or a first input 51 of the second shuttle valve 40 is connected in fluid communication to a junction 52 of the accumulator pressure line 21. The second input 53 of the second shuttle valve 40 is connected in fluid communication to a junction 55 of the pressure line 19 via a connecting line 54. In this arrangement, the output 56 of the shuttle valve 40 signals or conveys the respective higher pressure of accumulator pressure $p_A$ and system pressure $p_S$ to a first input 57 of shift valve 38. The second input 58 of the shift valve 38 is connected in fluid communication to the output port 41 of the switching valve 18 via a line 59. The control line 46 is connected in fluid communication to the output port 60 of the shift valve 38. The control line 46 runs to the third valve port 3 of the logic valve 14.

In the unactuated switching position, as shown in FIG. 2, the shift valve 38 signals or conveys the respective higher pressure, supplied by the second shuttle valve 40, of the accumulator pressure $p_A$ and the system pressure $p_S$ to the third effective surface area 34 of the logic valve 14. The logic valve 14 then remains in the shut-off state such that the accumulator 10 is safely shut off from the system. In the actuated state of the shift valve 38, as in the example of FIG. 2, the output port 41 of the switching valve 18 is in turn connected to the control line 46 via the line 59 and the output port 60, as in FIG. 1 is the case, such that the control function of the valve control device 12 is in turn activated. The shift valve 38 may be formed to be de-energized open or de-energized closed. Optionally, a minimum pressure setting proportional to current or voltage may also be provided for the switching valve 18.

While various embodiments have been chosen to illustrate the invention, it will be understood by those skilled in the art that various changes and modifications can be made therein without departing from the scope of the invention as defined in the claims.

The invention claimed is:

1. A system for charging and discharging a hydraulic accumulator, the system comprises:

a valve control device including an accumulator tap being connectable to the hydraulic accumulator in fluid communication and including a logic valve, a first shuttle valve and a switching valve, the logic valve, the first shuttle valve and the switching valve being interconnected in fluid communication with one another such that the switching valve receives and compares accumulator pressure from the accumulator tap to a minimum accumulator pressure with the first shuttle valve being connected to the switching valve via an output line of the first shuttle valve and with the switching valve being connected to the logic valve via a control line, the switching valve being hydraulically operated and having an adjustable control setting the minimum accumulator pressure.

2. A system according to claim 1 wherein the valve control device comprises a discharging valve being connected directly in fluid communication to the accumulator tap and to a tank or return port and safely discharging accumulator pressure from the accumulator tap to the tank or return port.

3. A system according to claim 1 wherein the adjustable control of the switching valve is proportional to at least one of electrical current or voltage.

4. A system according to claim 1 wherein the valve control device controls a fluid-conveying connection between the hydraulic accumulator and a hydraulic system.

5. A system according to claim 1 wherein the switching valve has opposite first and second control ends, the first control end being connected only to the adjustable control and a vent port, the second control end being connected to the accumulator port.

6. A system according to claim 5 wherein the adjustable control is an adjustable force spring.

7. A system according to claim 5 wherein the vent port is a tank port.

8. A system for charging and discharging a hydraulic accumulator, the system comprises:

a valve control device including an accumulator tap being connectable to the hydraulic accumulator in fluid communication and including a logic valve, a first shuttle valve and a switching valve, the logic valve, the first shuttle valve and the switching valve being interconnected in fluid communication with one another such that the switching valve receives and compares accumulator pressure from the accumulator tap to a minimum accumulator pressure, the switching valve being hydraulically operated and having an adjustable control setting the minimum accumulator pressure;

the switching valve being in a minimum pressure valve position by the adjustable control and a control pressure from the accumulator tap conveying accumulator pressure at the accumulator tap to a piston end of the logic valve acting as a non-return valve when the accumulator pressure at the accumulator tap is lower the minimum accumulator pressure to prevent the accumulator pressure from being discharged below the minimum accumulator pressure.

9. A system according to claim 8 wherein the adjustable control is an adjustable spring.

10. A system according to claim 8 wherein the logic valve, the first shuttle valve, the switching valve and a discharge valve are interconnected such that when accumulator pressure at the accumulator tap is higher than the minimum accumulator pressure, the switching valve moves to an actuated switching position and permits the first shuttle valve to convey a lower one of the accumulator pressures and a system pressure at a hydraulic system port to the piston end of the logic valve permitting fluid flow through the logic valve between the accumulator tap to the hydraulic system port and allowing the accumulator pressure to be charged and discharged.

11. A system according to claim 8 wherein a solenoid shut-off valve is connected between the logic valve and the switching valve and is configured to convey the higher of an accumulator pressure at the accumulator tap and a system pressure at a hydraulic system port to the piston end of the logic valve to move a piston of the logic valve to a closed position thereof shutting off the accumulator tap from the hydraulic system port and inactivating a hydraulic-mechanical accumulator control, when the solenoid shut-off valve is unactivated or activated by a second shuttle valve.

12. A system according to claim 11 wherein the solenoid shut-off valve is formed to be de-energized open or de-energized closed.

13. A system according to claim 8 wherein the logic valve comprises a stepped piston having a first side opposite the piston end controlling a fluid connection between the accumulator tap and a hydraulic system port connectable to a hydraulic system.

14. A system for charging and discharging a hydraulic accumulator, the system comprises:

a valve control device including an accumulator tap being connectable to the hydraulic accumulator in fluid communication and including a logic valve, a first shuttle valve and a switching valve, the logic valve, the first shuttle valve and the switching valve being interconnected in fluid communication with one another such that the switching valve receives and compares accumulator pressure from the accumulator tap to a minimum accumulator pressure, the switching valve being hydraulically operated and having an adjustable control setting the minimum accumulator pressure; and the logic valve, the first shuttle valve, the switching valve and a discharge valve being interconnected such that when accumulator pressure at the accumulator tap is higher than the minimum accumulator pressure, the switching valve moves to an actuated switching position and permits the first shuttle valve to convey a lower one of the accumulator pressures and a system pressure at a hydraulic system port to the piston end of the logic valve permitting fluid flow through the logic valve between the accumulator tap to the hydraulic system port and allowing the accumulator pressure to be charged and discharged.

15. A system according to claim 14 wherein a solenoid shut-off valve is connected between the logic valve and the switching valve and is configured to convey the higher of an accumulator pressure at the accumulator tap and a system pressure at a hydraulic system port to the piston end of the logic valve to move a piston of the logic valve to a closed position thereof shutting off the accumulator tap from the hydraulic system port and inactivating a hydraulic-mechanical accumulator control, when the solenoid shut-off valve is unactivated or activated by a second shuttle valve.

16. A system according to claim 15 wherein the solenoid shut-off valve is formed to be de-energized open or de-energized closed.

17. A system according to claim 14 wherein the logic valve comprises a stepped piston having a first side opposite the piston end controlling a fluid connection between the accumulator tap and a hydraulic system port connectable to a hydraulic system.

18. A system for charging and discharging a hydraulic accumulator, the system comprises:

a valve control device including an accumulator tap being connectable to the hydraulic accumulator in fluid communication and including a logic valve, a first shuttle valve and a switching valve, the logic valve, the first shuttle valve and the switching valve being interconnected in fluid communication with one another such that the switching valve receives and compares accumulator pressure from the accumulator tap to a minimum accumulator pressure, the switching valve being hydraulically operated and having an adjustable control setting the minimum accumulator pressure; and a solenoid shut-off valve being connected between the logic valve and the switching valve conveying the higher of an accumulator pressure at the accumulator tap and a system pressure at a hydraulic system port to the piston end of the logic valve moving a piston of the logic valve to a closed position thereof shutting off the accumulator tap from the hydraulic system port and inactivating a hydraulic-mechanical accumulator control, when the solenoid shut-off valve is unactivated or activated by a second shuttle valve.

19. A system according to claim 18 wherein the solenoid shut-off valve is formed to be de-energized open or de-energized closed.

20. A system according to claim 18 wherein the logic valve comprises a stepped piston having a first side opposite the piston end controlling a fluid connection between the accumulator tap and a hydraulic system port connectable to a hydraulic system.

21. A system for charging and discharging a hydraulic accumulator, the system comprises:

a valve control device including an accumulator tap being connectable to the hydraulic accumulator in fluid communication and including a logic valve, a first shuttle valve and a switching valve, the logic valve, the shuttle valve and the switching valve being interconnected in fluid communication with one another such that the switching valve receives and compares accumulator pressure from the accumulator tap to a minimum accumulator pressure, the switching valve being hydraulically operated and having an adjustable control setting the minimum accumulator pressure; and the logic valve including a stepped piston having a first side opposite the piston end controlling a fluid connection between the accumulator tap and a hydraulic system port connectable to a hydraulic system.

* * * * *